United States Patent [19]

Braun

[11] Patent Number: 4,876,975

[45] Date of Patent: Oct. 31, 1989

[54] SEWING MACHINE WITH A NEEDLE PLATE INSERT

[75] Inventor: Oskar Braun, Hochspeyer, Fed. Rep. of Germany

[73] Assignee: Pfaff Industriemaschinen GmbH, Fed. Rep. of Germany

[21] Appl. No.: 215,248

[22] Filed: Jul. 5, 1988

[30] Foreign Application Priority Data

Jul. 24, 1987 [DE] Fed. Rep. of Germany ..... 8710148

[51] Int. Cl.[4] ..... D05B 73/12

[52] U.S. Cl. ..... 112/260

[58] Field of Search ..... 112/260

[56] References Cited

U.S. PATENT DOCUMENTS

| | | | |
|---|---|---|---|
| 3,440,987 | 4/1969 | Coulombe | 112/260 |
| 3,513,795 | 5/1970 | Hagemeyer | 112/260 |
| 4,493,280 | 1/1985 | Bianchi | 112/260 |

*Primary Examiner*—Andrew M. Falik
*Attorney, Agent, or Firm*—McGlew & Tuttle

[57] ABSTRACT

A sewing machine is provided with a mechanism which is actuated by a drive unit and engages with a needle point insert. The mechanism moves a needle plate insert from a sewing position raised above a needle plate, in which the needle plate reinforces a fabric being clamped to a fabric holder, to a resting position not raised above the needle plate, in which the fabric holder may be moved and the fabric may be changed. The mechanism insures that this movement can be effected in a straightforward manner and with only slight wear and abrasion and while affording accurate transmission. The mechanism is fashioned as a straight-line mechanism with a first oscillating crank which is adjusted for setting the operating height of the needle plate insert and a separator crank for adjusting the insert between a rest position and an operating position.

9 Claims, 1 Drawing Sheet

SEWING MACHINE WITH A NEEDLE PLATE INSERT

BACKGROUND OF THE INVENTION

Field of the Invention

This invention relates, in general, to sewing machines and, in particular, to a new and useful sewing machine with an apparatus for adjusting the position of a surface of a needle plate insert relative to a needle plate.

A similar sewing machine is known, for instance, for U.S. Pat. No. 3,513,795. A needle plate insert is fastened to a pivoted first shaft, which has a beveled right-angle bend at one end. The right-angled bend interacts with a first angled end of a second pivoted shaft which has a second end which is linked by a lever to the piston rod of a cylinder. A journal of the piston rod can move in a sliding guideway of the lever.

The linear motion of the piston rod is transmitted to the first shaft by the drive unit. Accordingly, the shaft, together with the needle plate insert, can be switched from one position (sewing) to another position (resting) by a 90 -degree turning motion. In its sewing position, the needle plate insert protrudes beyond the needle plate, while in its resting position it does not.

In sewing machines as discussed above, the linear motion of the piston rod is transmitted to the needle plate insert across several sliding linkages. Rather intense wear occurs at the contact surfaces of these sliding links, due to friction. This produces an additional slackness in the gear mechanism, therefore the vertical height of the needle plate insert can only be approximately adjusted or inexactly adjusted. Further, the needle plate insert executes a swerving movement when in the sewing position under the effect of stress generated by stitch formation. The magnitude of deflections caused by the movement depends on the magnitude of the stress and on the tolerances in the gear mechanism.

SUMMARY OF THE INVENTION

The innovation includes a mechanism for transmitting the motion of a drive unit to a needle plate. The mechanism transmits the motion without causing significant abrasion of parts. The mechanism includes a straightforward arrangement of parts which transmit the motion with a great deal of accuracy.

By fashioning the gear mechanism as a straight-line mechanism, the number of gear elements for transmission of the drive motion to the needle plate insert is reduced to a minimum. Moreover, it is possible to employ turning knuckles everywhere to link together the individual gear elements. Since turning knuckles are not susceptible to abrasion, only a negligibly slight slackness of the mechanism is noticeable, even after a rather long operating time.

A further reduction in the number of gear elements is achieved by the fact that the second oscillating crank is also used as a carrier of the needle plate insert.

Advantageously, a first oscillating crank and a connecting rod are arranged so that automatic interlocking occurs by virtue of a dead center position established by the arrangement of parts. Hence, the needle plate insert, subjected to the force of the pressing arrangement of a needle piercing the fabric, can be supported more rigidly and with less vibration.

A drive unit of advantage to the movement of the first oscillating crank includes a fluid pressure operated piston and cylinder.

An advantageous design of the first oscillating crank includes a disc so that the drive unit and the connecting rod may engage eccentrically to the axis of rotation at any given point. An important feature of the invention provides that the needle plate insert, under the oscillating motions of the second oscillating crank, can move through almost parallel paths, since the crank can execute only negligibly small turning motions about the bearing element, by virtue of the very small difference in height between the sewing and the resting positions.

The height position of the bearing element of the second oscillating crank can be adjusted by twisting the eccentric, in the hub of the clamp. This also moves the needle plate insert over a portion of this distance, so that the height position of the plate insert relative to the needle plate can be adjusted. On the other hand, the relative position of the needle plate insert in the recess of the needle plate can be adjusted by twisting the clamp and the eccentric.

Accordingly, it is an object of the invention to provide an apparatus for adjusting the position of the surface of a needle plate insert which has a needle insertion hole relative to the surface of a needle plate which needle plate has a recess in which the insert is movable. The apparatus includes an insert carrier which is movable backwardly and forwardly and has a first end which is connected to a first pivotally movable member and an opposite second end which is connected to a second pivotal member and which carries the insert of the needle in an intermediate portion. The first pivotal adjusting member includes a rotatable eccentric bearing which adjusts the position of the frist pivotal member in respect to the first end of the insert carrier so as to adjust the height of the insert relative to the needle plate. The opposite second end of the carrier is adjusted by the second pivotal member which raises or lowers this end so as to change the operating position of the insert to one in which it projects above the surface of the needle plate during operation of the needle and to a position at rest in which it is retracted below the surface of the needle plate.

A further object of the invention is to provide a device which permits both an initial adjustment of an insert of a needle plate of a sewing machine and also permits an adjustment between an operative and a rest position of the insert.

A further object of the invention is to provide an apparatus for shifting an insert relative to a needle plate of a sewing machine which is simple in design, rugged in construction and economical to manufacture.

The various features of novelty which characterize the invention are pointed out with particularly in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DESCRIPTION OF THE PREFERRED EMBODIMENTS

Figure 2:
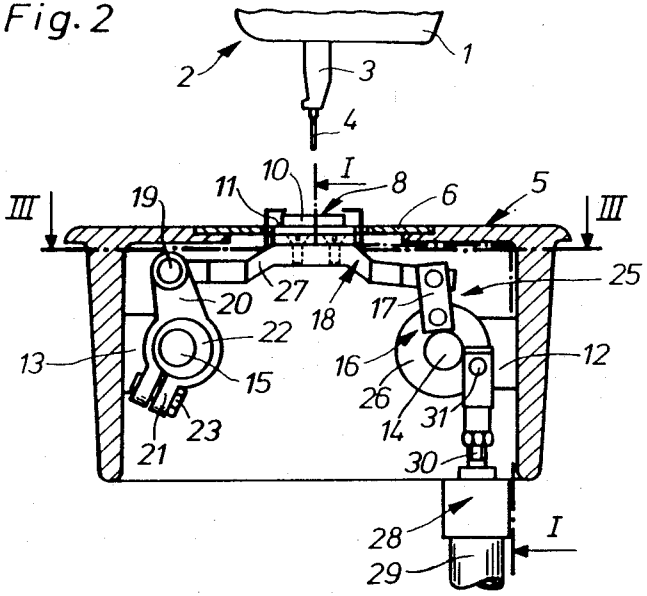
FIG. 2 is a section through the base plate taken along line II—II of FIG. 1.

Referring to the drawings, in particular, the invention embodied therein comprises an apparatus for adjusting the position of a surface 11 of an insert generally designated 8 which fits into a recess 7 of a needle plate 6 which is carried over a base plate 5 of a sewing machine.

In accordance with the invention, the insert 8 is carried on an intermediate portion of a carrier 27 which has a second end with a pivot 19 which is connected to a second pivotal member or clamp 21 which is mounted by adjustment means including a journal 15 and an eccentric 22 which may be adjusted to effect an initial positioning of the insert 8 relative to the needle plate 6. The apparatus also includes shifting means including a disc 26 rotatable on an shaft 14 acting on the first end of the carrier 27 to adjust the position of the insert 8 relative to the needle plate between an operating position in which it projects above the needle plate 6 and to an inoperative position in which a shoulder or protrudable portion 10 of the insert lies below the surface of the needle plate 6.

The base plate 5 is provided with bearing ribs 12 and 13, and a shaft 14 is secured in the bearing rib 12 and a journal 15 is secured in bearing rib 13. Pivoted on shaft 14 is a first oscillating crank assembly 16 which is hinged by a connecting rod 17 to a second oscillating crank assembly 18. The oscillating crank 18 is pivotally connected to a journal 19, which is pivoted in the fork-like end of a clamp 21, fashioned as a bearing element or lever 20. The clamp 21 is secured to an eccentric 22 (FIG. 3) which is arrranged on the journal 15. The clamp 21 can be fixed in position by a screw 23, the eccentric 22 by a set screw 24.

As shown in FIG. 2, the two oscillating cranks 16 and 18 together with the connecting rod 17 form a straight-line mechanism 25, in which the crank 16 can be formed as a disk 26, for example, and the crank 18 as the carrier 27 of the needle plate insert 8.

There is a drive unit 28 provided to actuate the straight-line mechanism 25. This is advantageously a fluid pressure operated piston and cylinder 29 for example. The piston rod 30 of the piston and cylinder 29 embraces a journal 31, which is formed on the disk 26 eccentric to its axis of rotation.

The arrangement works as follows.

Figure 3:
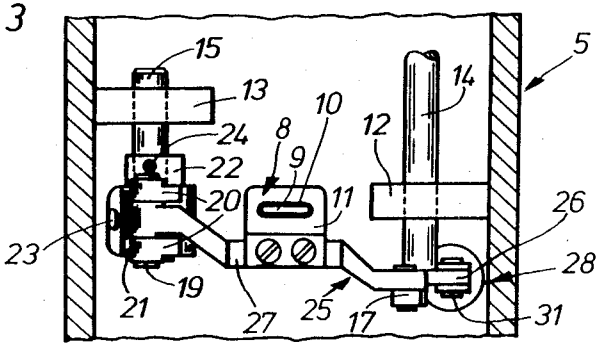
FIG. 3 is a section through the base plate taken along line III—III of FIG. 2.
Figure 1:
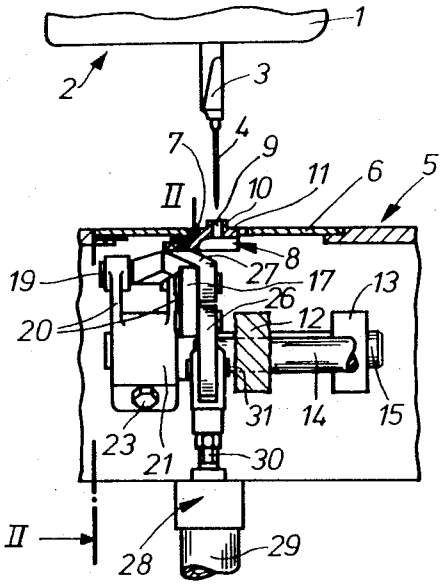
FIG. 1 is a partial elevational and sectional view taken along the line I—I of FIG. 2 of the head and base plate of a sewing machine.

In FIGS. 1, 2 and 3, the needle plate insert 8 is shown in its sewing position. The carrier 27 in this position is directed parallel to the needle plate 6, so that the surfaces 11 of the needle plate insert 8 terminates flush with the upper side of the needle plate 6. The shoulder or protrudable portion 10, then, projects far enough above the needle plate 6 so that the fabric, arranged on the latter and secured by a holder, as disclosed in U.S. Pat. No. 1,732,096, lies directly on the top side of the shoulder or protrudable portion 10 in the region of the stitching site.

In this position of the carrier 27, the connecting rod 17 lies in its extended position on the disk 26, so that the straight-line mechanism 25 by virtue of the automatic interlocking is retained in the sewing position without additional locking devices. In this position, the crank 16 is at its top dead center position with the connecting rod 17 in its extended position. This arrangement allows forces to be transmitted directly from the carrier plate 27 through a pin or the like connecting the connecting rod 17 to the carrier plate, through the connecting rod 17 and to the pin connecting the connecting rod 17 to the first crank 16. The line of action of this force coincides with the shaft 14 (the connecting rod and shaft 14 are in a straightline).

The needle plate insert 8 can be lowered into its resting position, so that the shoulder or protrudable portion 10 no longer projects above the needle plate 6 and the fabric holder may be moved for changing the fabric. For this, the cylinder 29 is actuated in such a way that its piston rod 30 is extended and the disk 26 is turned through a predetermined angle in accordance with FIG. 2. The end of the connecting rod 17 engaging with the disk 26 is thereby moved along a circular arc about the axis 14 into a lower position, whereupon the connecting rod 17 executes a right-hand turning motion and pulls the carrier 27 downward.

After changing the fabric, the needle plate insert 8 is again lifted into its sewing position. For this, the piston rod 30 is again retracted, so that the disk 26, the connecting rod 17 and the carrier 27 are returned to their initial positions, again lifting the needle plate insert 8.

The height of the needle plate insert can be adjusted via the eccentric 22.

For this, the screw 23 of the clamp 21 and the set-screw 24 of the eccentric 22 are loosened and the eccentric 22 is turned relative to the journal 15 and to the clamp 21. Once the proper height of the needle plate insert 8 is achieved, the clamp 21 and eccentric 22 are again fastened tight.

The relative position of the needle plate insert 8 within the recess 7 can be adjusted by turning the clamp 21 relative to the journal 15, after loosening the screw 23. If the height of the needle plate insert 8 has been measurably affected by this, it should be adjusted once again.

While a specific embodiment of the invention has been shown and described in detail to illustrate the application of the principals of the invention, it will be understood that the invention may be embodied otherwise without departing from such principles.

What is claimed is:

1. An apparatus for adjusting the position of a surface of a needle plate insert which has a needle insertion hole therethrough, relative to the surface of a needle plate which has a recess in which the needle plate insert is movably positionable, comprising an insert carrier movable backwardly and forwardly and having first and second opposite ends, the needle plate insert having a hole therethrough for the passage of a needle, the needle plate insert being connected to said carrier and being positionable in the recess of the needle plate, a first pivotal member articulated to said first end of said insert carrier, a second pivotal member articulated to said second end of said insert carrier, adjustment means pivotally connected to the second pivotal member to raise and lower said carrier and thereby adjust the height of the needle plate insert surface relative to the needle plate, and a rocker arm operatively connected with shifting means, said rocker arm being pivotally mounted to said first pivotal member, said shifting means moving said rocker arm to raise and lower said first end of the needle plate insert carrier to move the surface of said insert carrier between an operating position in which the surface is above said needle plate and a rest position in which the surface of said insert is below said needle plate surface.

2. An apparatus according to claim 1, wherein said second pivotal member comprises a crank, and a connecting rod connected between said crank and said second end of said carrier.

3. An apparatus according to claim 1, including a drive unit connected to said first pivotal member comprising a fluid-pressure operated cylinder and piston, said piston having a rod portion connected to said first pivotal member.

4. An apparatus according to claim 1, wherein said first pivotal member includes a central member forming and axis, a disc rotatable on said axis, a connecting rod connected to said disk at one end and having an opposite end connected to said first end of said carrier and including a drive unit connected to said disk to rotate said disk.

5. An apparatus according to claim 1, wherein said carrier moves substantially parallel to said needle plate and which is raised by said second pivotal member in a direction toward said needle plate and carries said insert.

6. An apparatus according to claim 1, wherein said second pivotal member comprises a journal, an eccentric rotatable on said journal, a pivotal clamp lever mounted on said eccentric and comprising said second pivotal member connected to said carrier.

7. An apparatus according to claim 4, including a bearing rib supporting said second pivotal member, an additional bearing rib spaced from said first bearing rid and carrying said rotational axis for said disk.

8. A sewing machine with a mechanism, activating a needle plate insert, said mechanism serving to move said needle plate insert from a sewing position higher than the level of a needle plate to a resting position not higher than the needle plate, the mechanism comprising:

a first crank assembly including a first crank member rotatably mounted on a first crank assembly shaft;

a second crank assembly including a second crank member having a carrier portion connected to the needle plate insert, said second crank member having a second end articulated to a bearing element;

a connecting rod having a rod first end articulated to a first end of said second crank member and a rod second end articulated to said first crank assembly;

a drive unit connected to said first crank member for moving said first crank member between a first position and a second position, said first position and said second position corresponding to said sewing position and said resting position respectively, in said first position said connecting rod being in a top dead center position allowing forces to be transmitted to said first crank assembly shaft along a straightline intersecting said first crank assembly shaft.

9. A sewing machine mechanism according to claim 8, wherein said bearing elememt includes a clamp portion positioned about an eccentric member, adjustment of said clamp portion relative to said eccentric member causing said carrier portion and said needle plate insert to be adjusted in a vertical direction with respect to said needle plate.

* * * * *